US008574087B1

(12) United States Patent
Newcombe et al.

(10) Patent No.: US 8,574,087 B1
(45) Date of Patent: Nov. 5, 2013

(54) MECHANICAL RIDE SAFETY SYSTEM

(76) Inventors: Ian F. Newcombe, Leicester (GB); Keith Lawrence, Worcester (GB)

( * ) Notice: Subject to any disclaimer, the term of this patent is extended or adjusted under 35 U.S.C. 154(b) by 220 days.

(21) Appl. No.: 13/283,787

(22) Filed: Oct. 28, 2011

(51) Int. Cl.
*A63G 13/06* (2006.01)
*G09B 19/00* (2006.01)

(52) U.S. Cl.
USPC ..... 472/100; 434/247

(58) Field of Classification Search
USPC ..... 472/95–101; 482/51, 57, 58, 61, 63; 434/247
See application file for complete search history.

(56) References Cited

U.S. PATENT DOCUMENTS 3,062,541 A * 11/1962 Price ..... 472/97
6,105,345 A * 8/2000 Dunton et al. ..... 54/1
6,264,569 B1 * 7/2001 Cannavino ..... 472/95
7,201,709 B1 * 4/2007 Pebbles, Jr. ..... 482/95
8,047,924 B2 * 11/2011 Tirelli ..... 472/96
8,246,479 B2 * 8/2012 Tirelli ..... 472/96

* cited by examiner

*Primary Examiner* — Kien Nguyen
(74) *Attorney, Agent, or Firm* — Jason L. Gilbert

(57) ABSTRACT

A mechanical ride safety system for automatically disabling a mechanical ride in response to a rider losing his/her grip on the ride. The mechanical ride safety system generally includes a gripping member that is grasped by a rider when the ride in in use. The gripping member includes a sensing member which is adapted to sense whether the gripping member is being grasped or has been released. A processing unit and transmitter are communicatively interconnected with the sensing member so that a signal may be transmitted when the gripping member is released. A receiver is communicatively interconnected with the control unit of the mechanical ride such that, upon receiving a signal indicating that the gripping member has been released, the control unit will automatically disable the mechanical ride to prevent injury to the rider.

20 Claims, 4 Drawing Sheets

MECHANICAL RIDE SAFETY SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a safety system and more specifically it relates to a mechanical ride safety system for automatically disabling a mechanical ride in response to a rider losing his/her grip on the ride.

2. Description of the Related Art

Any discussion of the related art throughout the specification should in no way be considered as an admission that such related art is widely known or forms part of common general knowledge in the field.

Mechanical rides such as mechanical bulls and the like have been in use for many years. Generally, such mechanical rides will erratically move in various directions to provide an enjoyable ride for the rider. The rider of such a mechanical ride will usually attempt to stay on the ride without falling off for as long as possible.

Due to the nature of such mechanical rides, there is a high risk of injury when a rider is knocked off and falls to the ground. If the ride does not stop motion, it can easily slam into the body of the rider and cause injury or even death.

Existing systems utilize a separate cut-off device such as a strap which is removably attached to the ride itself and fixedly attached to the rider. When the rider falls off, the cut-off device detaches from the ride; causing it to cease operation. In some circumstances, the rider can fall without entirely pulling out the cut-off device. In other circumstances, the rider can accidentally stop the ride prematurely by inadvertently detaching the cut-off device.

Because of the inherent problems with the related art, there is a need for a new and improved mechanical ride safety system for automatically disabling a mechanical ride in response to a rider losing his/her grip on the ride.

BRIEF SUMMARY OF THE INVENTION

The invention generally relates to a safety system for a mechanical ride which includes a mechanical ride such a mechanical bull which includes a gripping member that is grasped by a rider when the ride in in use. The gripping member includes a sensing member which is adapted to sense whether the gripping member is being grasped or has been released. A processing unit and transmitter are communicatively interconnected with the sensing member so that a signal may be transmitted when the gripping member is released. A receiver is communicatively interconnected with the control unit of the mechanical ride such that, upon receiving a signal indicating that the gripping member has been released, the control unit will automatically disable the mechanical ride to prevent injury to the rider.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
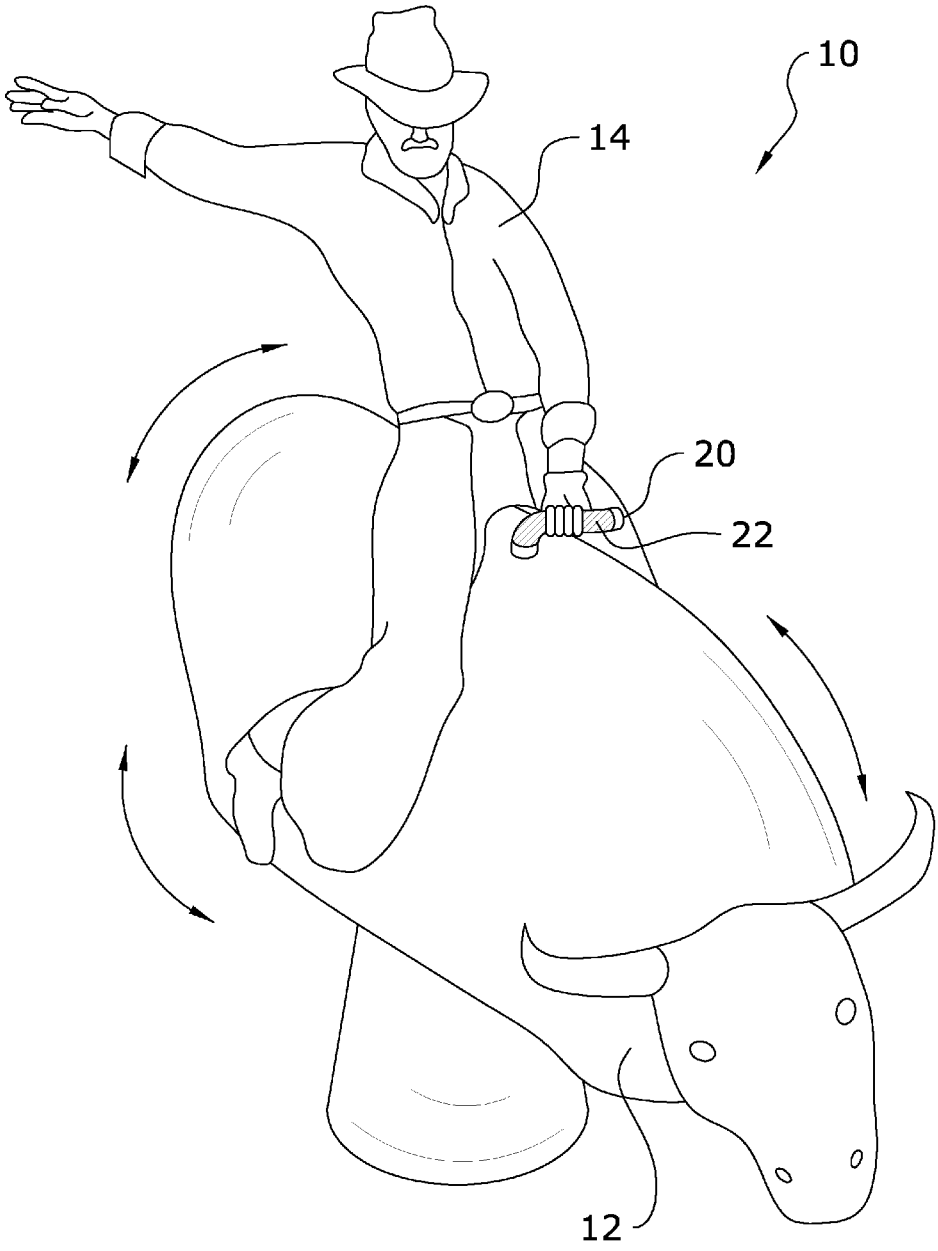
FIG. 1 is a first upper perspective view of the present invention in use.
Figure 2:
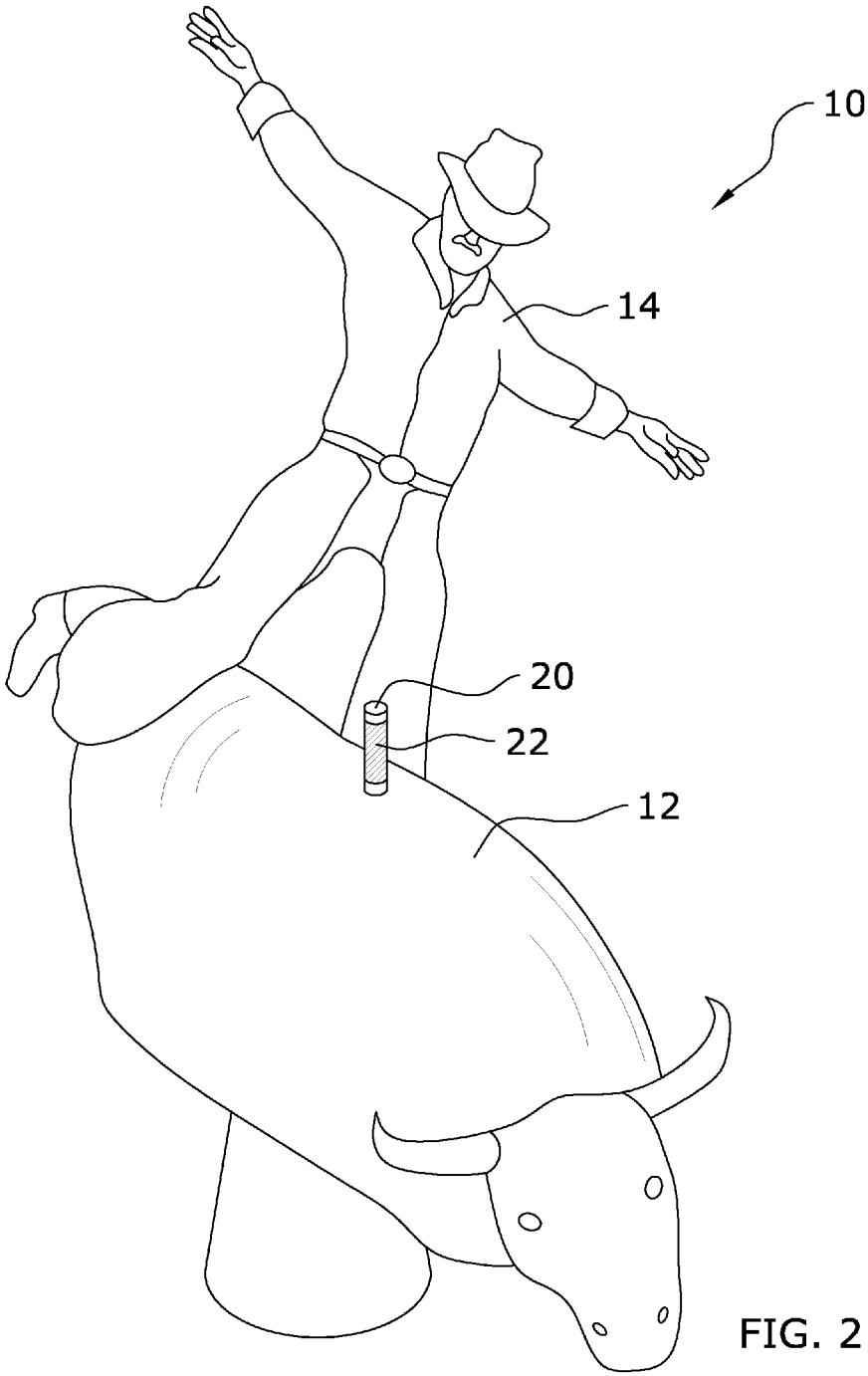
FIG. 2 is a second upper perspective view of the present invention in use.
Figure 3:
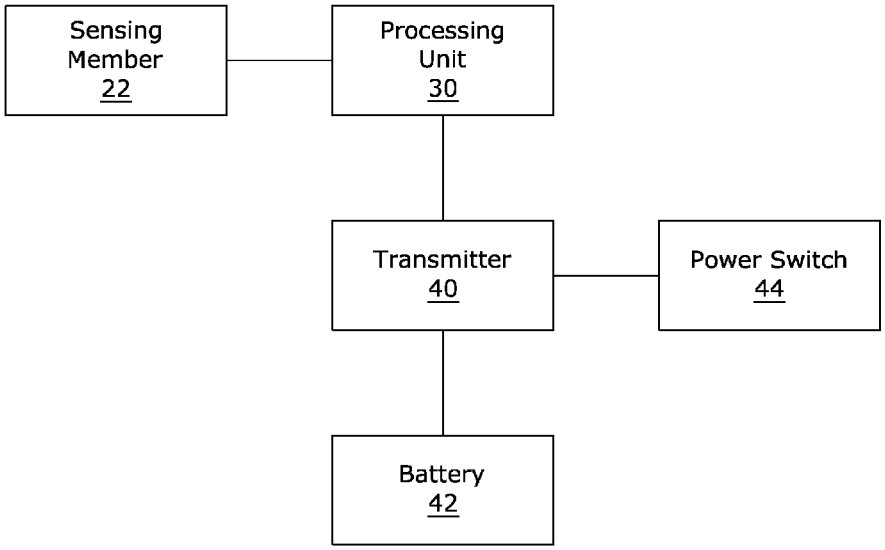
FIG. 3 is a block diagram illustrating the connection of the elements of the present invention.
Figure 4:
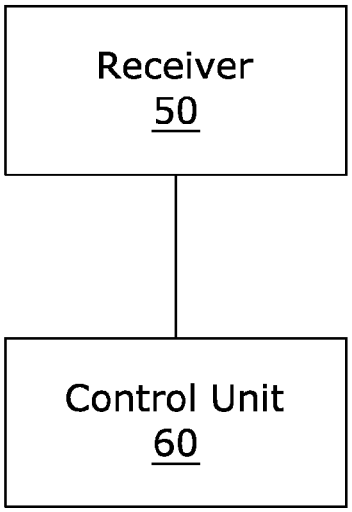
FIG. 4 is a block diagram illustrating the connection of the receiver and control unit features of the present invention.

A. Overview.

Turning now descriptively to the drawings, in which similar reference characters denote similar elements throughout the several views, FIGS. 1 through 4 illustrate a mechanical ride safety system 10, which comprises a mechanical ride 12 such a mechanical bull which includes a gripping member 20 that is grasped by a rider 14 when the ride 12 in in use. The gripping member 20 includes a sensing member 22 which is adapted to sense whether the gripping member 20 is being grasped or has been released. A processing unit 30 and transmitter 40 are communicatively interconnected with the sensing member 22 so that a signal may be transmitted when the gripping member 20 is released. A receiver 50 is communicatively interconnected with the control unit 60 of the mechanical ride 12 such that, upon receiving a signal indicating that the gripping member 20 has been released, the control unit 60 will automatically disable the mechanical ride 12 to prevent injury to the rider 14.

B. Mechanical Ride.

The present invention is adapted for use with various types of mechanical rides 12. It is appreciated that, although the figures only illustrate use of the present invention in combination with a mechanical bull, the principles and features of the present invention may be applied to any other type of mechanical ride 12 which includes the risk of a rider 14 falling off and thus being injured. Accordingly, the present invention should not be construed as being limited to only mechanical bulls, but instead should be construed as encompassing a wide range of mechanical rides 12.

The mechanical ride 12 with which the present invention is utilized will generally include some type of gripping member 20. The gripping member 20 is comprised of a structure or portion of the mechanical ride 12 which the rider 14 will grip or hold onto while the mechanical ride 12 is in motion. By way of example, the gripping member 20 of a mechanical bull ride 12 is generally comprised of a handle which extends upwardly from the back of the mechanical bull.

In order to sense when a rider 14 has released the gripping member 20 of the mechanical ride 12, a sensing member 22 is provided. The sensing member 22 will preferably be positioned on the outer surface of the gripping member 20 in a manner which allows the sensing member 22 to effectively sense whether the gripping member 20 is being contacted by the hand of the rider 14. In a preferred embodiment, the sensing member 22 will be comprised of a dielectric material which substantially covers the outer surface of the gripping member 20 as shown in FIG. 1. It is appreciated, however, that various other materials and devices may be utilized so long as they are capable of sensing the release of the gripping member 20 by the rider 14.

The sensing member 22 will generally be communicatively interconnected with a processing unit 30. The sensing member 22 and processing unit 30 may be interconnected via a wired or wireless connection. The processing unit 30 may be positioned in various locations, such as within the main body of the mechanical ride 12 (i.e. torso on a mechanical bull). The processing unit 30 will process the data being provided by the sensing member 22. Various types of processing units 30 may be utilized, so long as they are capable of effectively interacting with the sensing member 22 to determine when a rider 14 has lost his/her grip.

The mechanical ride 12 will also generally include a transmitter 40. The transmitter 40 is communicatively interconnected with and driven by the processing unit 30. When the sensing member 22 detects release of the gripping member 20, the processing unit 30 will direct the transmitter 40 to transmit a signal. In some embodiments, the opposite arrangement may be utilized (processing unit 30 directs the transmitter 40 to stop transmitting a signal upon release of the gripping member 20).

The transmitter 40 may be comprised of various types of communications devices. In a preferred embodiment, the transmitter 40 will be comprised of a radio frequency transmitter 40. However, it is appreciated that the transmitter 40 should not be construed as being limited to such an embodiment, and various other types of transmitters 40 may be utilized without affecting overall operation of the present invention so long as the transmitter 40 is capable of effectively communicating with the receiver 50 of the present invention.

The transmitter 40 may be positioned in various locations, but will generally be positioned within the body of the mechanical ride 12 itself. It is also appreciated that, in some embodiments, the transmitter 40, processing unit 30 and/or sensing member 22 may be integrally formed.

The transmitter 40 will generally include a battery 42 and a power switch 44. The battery 42 provides power to the system and the power switch 44 allows the system to be shut off when not in use. Various types of batteries 42 may be utilized, and it is appreciated that the power switch 44 may be comprised of various configurations and be placed at various locations.

C. Control Unit.

The transmitter 40 of the present invention will communicate wirelessly with a receiver 50. The receiver 50 will generally be located near the control unit 60 for the mechanical ride 12 itself. The receiver 50 and control unit 60 will preferably be in a located which overlooks the mechanical ride 12.

The receiver 50 may be comprised of various types of devices, but will preferably be comprised of a device which is capable of receiving and processing signals sent from the transmitter 40. In a preferred embodiment, the receiver 50 will be comprised of a radio frequency receiver which is set to recognize signals sent from the transmitter 40.

The control unit 60 is comprised of the device or system which controls motion of the mechanical ride 12. Generally, a control booth or panel is provided which is utilized to start and stop motion of the mechanical ride 12. The control unit 60 is communicatively interconnected with the receiver 50 so that the control unit 60 recognizes whether the receiver 50 is receiving or not receiving a signal from the transmitter 40. The control unit 60 of the present invention is adapted to automatically shut down the mechanical ride 12 in response to a preset event (i.e. loss of signal from the transmitter 40).

D. Operation of Preferred Embodiment.

In use, a rider 14 will first position himself on the mechanical ride 12 and grab the gripping member 20 with his/her hand as shown in FIG. 1. The sensing member 22 will detect that the gripping member 20 is being held. This information will be processed by the processing unit 30, which will direct the transmitter 40 to transmit a signal to the receiver 50 indicating that the gripping member 20 is being held. The ride 12 may then be activated. When the rider 14 loses his/her grasp on the gripping member 20, the sensing member 22 will detect loss of contact and the processing unit 30 will direct the transmitter 40 to stop transmitting a signal to the receiver 50. Upon cessation of receipt of the signal, the control unit 60 will automatically disable the mechanical ride 12.

It is appreciated that, in an alternate embodiment, the transmitter 40 may be adapted to not send a signal when the gripping member 20 is being held and instead transmit a stop signal when it detects that the gripping member 20 has been released. In either case, the control unit 60 is responding to information received from the transmitter 40 by the receiver 20 to determine whether to continue operation of the ride 12.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A mechanical ride safety system, comprising:

a mechanical ride;

a gripping member positioned on said mechanical ride, wherein said gripping member is grasped by a rider of said mechanical ride when in use;

a sensing member positioned on said gripping member, wherein said sensing member is adapted to detect when said gripping member has been released by said rider;

a transmitter, wherein said transmitter is adapted to transmit a signal when said gripping member is being grasped by said rider and wherein said transmitter is adapted to cease transmitting said signal when said gripping member is released by said rider;

a receiver, wherein said receiver is adapted to receive said signal from said transmitter; and a control unit, wherein said control unit is adapted to shut down said mechanical ride when said gripping member is released by said rider.

2. The mechanical ride safety system of claim 1, wherein said mechanical ride is comprised of a mechanical bull.

3. The mechanical ride safety system of claim 1, wherein said transmitter is comprised of a radio frequency transmitter.

4. The mechanical ride safety system of claim 3, wherein said receiver is comprised of a radio frequency receiver.

5. The mechanical ride safety system of claim 1, wherein said gripping member is comprised of a handle.

6. The mechanical ride safety system of claim 1, wherein said sensing member is comprised of a dielectric material.

7. The mechanical ride safety system of claim 1, further comprising a processing unit communicatively interconnected with said sensing member and said transmitter.

8. The mechanical ride safety system of claim 1, wherein said sensing member substantially covers said gripping member.

9. A mechanical ride safety system, comprising:

a mechanical ride;

a gripping member positioned on said mechanical ride, wherein said gripping member is grasped by a rider of said mechanical ride when in use;

a sensing member positioned on said gripping member, wherein said sensing member is adapted to detect when said gripping member has been released by said rider;

a transmitter, wherein said transmitter is adapted to transmit a signal when said gripping member is released by said rider and wherein said transmitter is adapted to cease transmitting said signal when said gripping member is grasped by said rider;

a receiver, wherein said receiver is adapted to receive said signal from said transmitter; and a control unit, wherein said control unit is adapted to shut down said mechanical ride when said gripping member is released by said rider.

10. The mechanical ride safety system of claim 9, wherein said mechanical ride is comprised of a mechanical bull.

11. The mechanical ride safety system of claim 9, wherein said transmitter is comprised of a radio frequency transmitter.

12. The mechanical ride safety system of claim 11, wherein said receiver is comprised of a radio frequency receiver.

13. The mechanical ride safety system of claim 9, wherein said gripping member is comprised of a handle.

14. The mechanical ride safety system of claim 9, wherein said sensing member is comprised of a dielectric material.

15. The mechanical ride safety system of claim 9, further comprising a processing unit communicatively interconnected with said sensing member and said transmitter.

16. The mechanical ride safety system of claim 9, wherein said sensing member substantially covers said gripping member.

17. The mechanical ride safety system of claim 9, wherein said transmitter is positioned within said mechanical ride.

18. A mechanical ride safety system, comprising:

a mechanical ride, wherein said mechanical ride is comprised of a mechanical bull;

a gripping member positioned on said mechanical ride, wherein said gripping member is grasped by a rider of said mechanical ride when in use, wherein said gripping member is comprised of a handle;

a sensing member positioned on said gripping member, wherein said sensing member is adapted to detect when said gripping member has been released by said rider, wherein said sensing member is comprised of a dielectric material;

a transmitter, wherein said transmitter is adapted to transmit a signal when said gripping member is released by said rider and wherein said transmitter is adapted to cease transmitting said signal when said gripping member is grasped by said rider, wherein said transmitter is comprised of a radio frequency transmitter;

a receiver, wherein said receiver is adapted to receive said signal from said transmitter, wherein said receiver is comprised of a radio frequency receiver; and a control unit, wherein said control unit is adapted to shut down said mechanical ride when said gripping member is released by said rider.

19. The mechanical ride safety system of claim 18, further comprising a processing unit communicatively interconnected with said sensing member and said transmitter.

20. The mechanical ride safety system of claim 18, wherein said sensing member substantially covers said gripping member.

* * * * *